US007933381B2

(12) United States Patent
Kamino et al.

(10) Patent No.: US 7,933,381 B2
(45) Date of Patent: Apr. 26, 2011

(54) HF FREQUENCY TUNING DEVICE

(75) Inventors: Yuichiro Kamino, Aichi (JP); Kazuhiro Tsukuda, Hiroshima (JP); Sadao Miura, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/708,031

(22) Filed: Feb. 20, 2007

(65) Prior Publication Data

US 2007/0189458 A1 Aug. 16, 2007

(51) Int. Cl.
*H05G 1/20* (2006.01)

(52) U.S. Cl. ..... 378/105; 378/119

(58) Field of Classification Search ..... 378/105, 378/119

See application file for complete search history.

(56) References Cited

U.S. PATENT DOCUMENTS 3,858,121 A * 12/1974 Kaneko et al. ..... 331/9
4,656,394 A * 4/1987 Perraudin ..... 315/5.41
4,992,744 A * 2/1991 Fujita et al. ..... 315/505
5,537,449 A * 7/1996 Nezu ..... 375/376
6,621,356 B2 9/2003 Götz et al.
2002/0153959 A1* 10/2002 Gotz et al. ..... 331/1 A
2005/0089141 A1* 4/2005 Brown ..... 378/65

FOREIGN PATENT DOCUMENTS

JP H08-018446 A 1/1996

OTHER PUBLICATIONS

C.J. Karzmark, Creig S. Nunan and Eiji Tanabe, 1993, Medical Electron Accelerators, McGraw-Hill, New York, Table of contents and Preface.

* cited by examiner

*Primary Examiner* — Hoon Song
*Assistant Examiner* — Mona M Sanei
(74) *Attorney, Agent, or Firm* — Benjamin Hauptman; Manabu Kanesaka; Kenneth Berner

(57) ABSTRACT

An HF frequency tuning device includes a resonance cavity in which an HF is introduced, a phase detecting section which generates a sign data representing a sign of a phase difference between a traveling wave and a reflected wave included in the HF in the resonance cavity. The frequency of the HF is repeatedly shifted by a first pitch. The direction of the shift is determined by the sign data for reducing the phase difference. When the sign is inverted, the frequency of the HF is repeatedly shifted to the opposite direction by a second pitch smaller than the first pitch until the sign is inverted again. By this tuning process, the fine tuning of HF can by achieved in a short time.

7 Claims, 4 Drawing Sheets

HF FREQUENCY TUNING DEVICE

BACKGROUND OF THE INVENTION

1. Field of the Invention

The present invention relates to a device for tuning a frequency so that a high frequency wave (HF) is resonated in a resonant cavity.

2. Description of the Related Art

There is known a device that generates the high frequency wave resonated in a cavity to accelerate electrons by the high frequency wave. The accelerated electrons are irradiated to a metal target, for example, to be used for generating X-rays. The generated X-rays are irradiated to a diseased part of a human body in a radiotherapy apparatus.

In order for the high frequency wave to resonate in a cavity, it is necessary for the frequency of the high frequency wave to match with that of the resonant frequency in the cavity with a high accuracy. The resonant frequency changes depending on the environmental conditions, fluctuations in the temperatures caused by introducing the high frequency to the cavity, and the like. Therefore, it is necessary to adjust the frequency assuming that there is shift in the resonant frequency.

In a published textbook (C. J. Karzmark, Craig S. Nunan and Eiji Tanabe, 1993, Medical Electron Accelerators, McGraw-Hill, New York), a technique for tuning the frequency of a microwave to be resonated in an acceleration cavity is described. This conventional technique is capable of performing a control when a phase difference between a phase of traveling wave towards the acceleration cavity and a phase of reflection wave that is reflected from the acceleration cavity falls within a narrow range of −90 degree to 90 degree, however, it is not capable of performing the control when the phase difference is beyond that range. In addition, the range of the high frequency value falling within the range of the phase difference, −90 degree to 90 degree, is extremely narrow especially for the acceleration cavity with a high Q-value. Thus, it is difficult to achieve the controllable phase difference within the range of −90 degree to 90 degree.

SUMMARY OF THE INVENTION

It is an object of the present invention to provide an HF (high frequency wave) frequency tuning device that makes it easier to make a large adjustment of the frequency such that the high frequency wave is resonated in a cavity with a high Q-value.

It is another object of the present invention to provide an HF (high frequency wave) frequency tuning device that quickly adjusts the frequency such that the high frequency wave is resonated in a cavity with the high Q-value.

It is still another object of the present invention to provide an HF (high frequency wave) frequency tuning device which is capable of adjusting the frequency of the high frequency wave in a resonant cavity by a control that is robust against electric noises.

To achieve the objectives, the HF frequency tuning device according to the present invention includes: an HF generator configured to generate a high frequency wave; a resonance cavity in which the high frequency wave is introduced; a phase detecting section configured to generate a sign data which represents the sign of the phase difference between the traveling wave and the reflected wave included in the high frequency wave in the resonance cavity; and a controlling section configured to control the frequency of the high frequency wave to reduce the phase difference based on said sign data.

Preferably, the phase detecting section generates the sign data to represent that the phase difference is zero when the absolute value of the phase difference is smaller than a predetermined value.

Preferably, the HF frequency tuning device further includes: a storage device storing a first pitch value. The controlling section executes a first controlling process in which the frequency of said high frequency wave is repeatedly shifted by the first pitch value until the sign represented in said sign data is inverted.

More preferably, the storage device stores a second pitch value which is smaller than the first pitch value. The controlling section shifts the frequency of said high frequency repeatedly by the second pitch value until the sign represented in the sign data is inverted after the first controlling process.

The HF acceleration device according to the present invention includes: an electron beam generator configured to generate an electron beam; and an electron accelerator having the configuration of the HF frequency tuning device according to the present invention.

The radiotherapy accelerator according to the present invention includes: an electron beam generator for generating an electron beam; an electron accelerator having the configuration of the HF frequency tuning device and accelerate the electron beam, and a metal target in which an X-ray is generated from the energy of entered electron beam accelerated in the electron accelerator.

The HF frequency tuning method according to the present invention includes: introducing a high frequency wave into a resonance cavity; generating a sign data representing the sign of the phase difference between the traveling wave and the reflected wave included in the high frequency wave in the resonance cavity; and adjusting the frequency of the high frequency wave to reduce the phase difference based on the sign data.

It is possible with the present invention to provide the HF (high frequency wave) frequency tuning device that makes it easier to adjust the frequency in such a manner that the high frequency wave is resonated in a cavity with the high Q-value.

Further, it is possible with the present invention to provide an HF (high frequency wave) frequency tuning device that quickly adjusts the frequency in such a manner that the high frequency wave is resonated in a cavity with the high Q-value. Furthermore, it is possible with the present invention to provide an HF (high frequency wave) frequency tuning device which is capable of adjusting the frequency of the high frequency wave in a resonant cavity by a control that is robust against electric noises.

DESCRIPTION OF THE PREFERRED EMBODIMENTS

A preferred embodiment of the present invention will be described in detail hereinafter by referring to the attached drawings.

Figure 1:
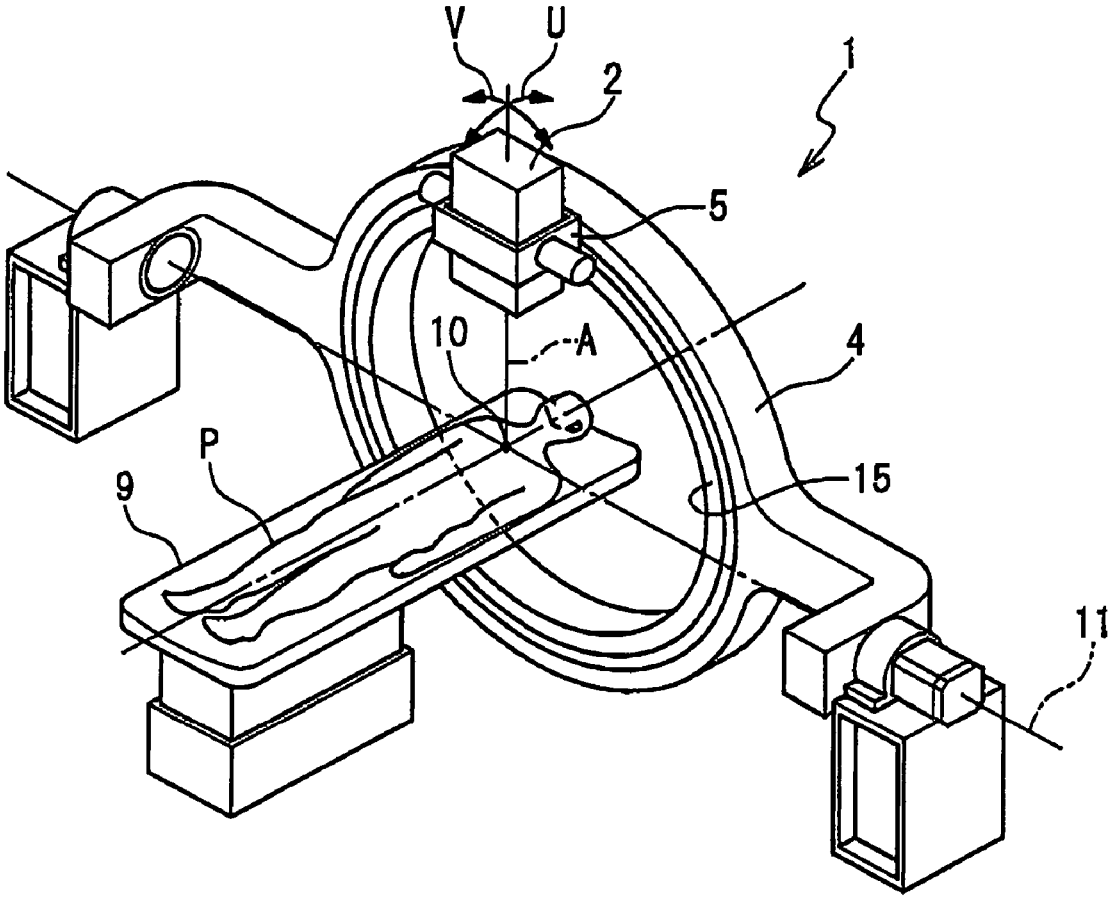
FIG. 1 shows the structure of a radiotherapy apparatus.

FIG. 1 shows a radiotherapy apparatus according to the present embodiment. A radiotherapy apparatus 1 includes a ring 4. The ring 4 can rotate around a horizontal (or vertical in some cases) rotation axis 11 that goes through about the diameter of the ring. A circling orbit 15 is provided to the ring 4. A gimbal mechanism 5 having a radiation generating device 2 loaded thereon is mounted to the ring 4. This radiation generating device 2 is a small C-band standing wave type electron accelerator with a high Q-value. The gimbal mechanism 5 moves along the circling orbit 15. The gimbal mechanism 5 performs swing actions along two axes shown in the drawing as U-axis (a direction vertical to the circling orbit 15) and V-axis (a direction along the circling orbit 15) for changing direction A along which the radiation generating device 2 irradiates radiations. There is an isocenter 10 near the center of the ring 4, to which the radiations are intensively irradiated. The radiotherapy apparatus 1 is provided with a treatment table 9 on which a patient P is laid down. The diseased part of the body of the patient P laid down on the treatment table 9 is located at the position of the isocenter 10.

Figure 2:
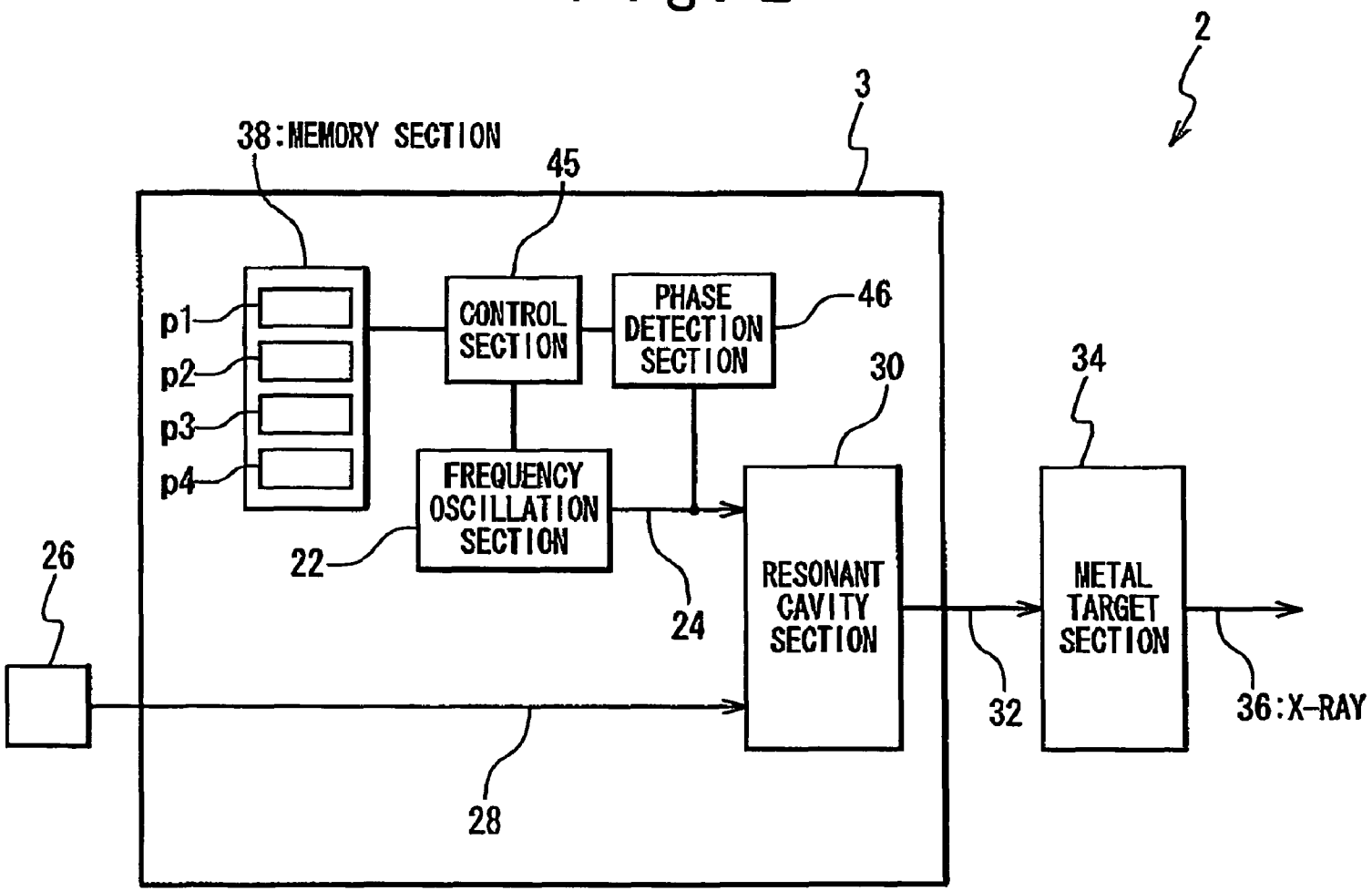
FIG. 2 shows the structure of a radiation generating device.

FIG. 2 shows the structure of the radiation generating device 2. The radiation generating device 2 includes an electron supply section 26, an acceleration section 3, and a metal target section 34. The electron supply section 26 generates electrons 28 and supplies those to a resonant cavity section 30 included in the acceleration section 3. The acceleration section 3 accelerates the supplied electrons 28. The metal target section 34 receives electron beam 32 outputted from the acceleration section 3 in a metal target so that the X-ray 36 is generated.

The acceleration section 3 includes a high frequency oscillation section 22. The high frequency oscillation section 22 generates high frequency wave (or microwaves). The generated high frequency wave is of S band (2856 MHz bandwidth), C band (5712 MHz bandwidth), etc., for example. The acceleration section 3 further includes a resonant cavity section 30 that has a cavity to which the high frequency generated by the high frequency oscillation section 22 is introduced, a memory section 38, a control section 45, and a phase detection section 46.

The memory section 38 can be realized by a computer readable storage device and stores a first pitch value p1, a second pitch value p2, a third pitch value p3, and a fourth pitch value p4. There is a following relation regarding those values: p1>p2>p3>p4. The p1 to p4 indicate the pitches of the shift when adjusting the frequency. For example, p1=400 KHz, p2=200 KHZ, p3=100 KHz, and p4=50 KHz.

The phase detection section 46 detects the phase difference between a high-frequency traveling wave that is supplied to the resonant cavity section 30 from the high frequency oscillation section 22 and a high-frequency reflection wave that returns to the high frequency oscillation section 22 from the resonant cavity section 30. The phase detection section 46 further includes a comparator. The comparator outputs different signals in accordance with the sign of the detected phase difference. Alternatively, the comparator outputs a signal indicating the coincidence when an absolute value of the phase difference is smaller than a predetermined value and, otherwise, outputs a signal indicating a phase-advance or a signal indicating a phase-delay in accordance with the sign of the phase difference.

The control section 45 adjusts the value of the high frequency generated by the high frequency oscillation section 22, by using three-valued (or tri-quantized) phase difference outputted from the phase detection section 46 and the pitch values stored in the memory section 38. Many of the recent high-frequency wave supply device employs a PLL (Phase Locked Loop) controlled synthesizer system for the primary oscillator, so that it is easy to perform a control to shift the frequency by the pitch value.

Figure 3:
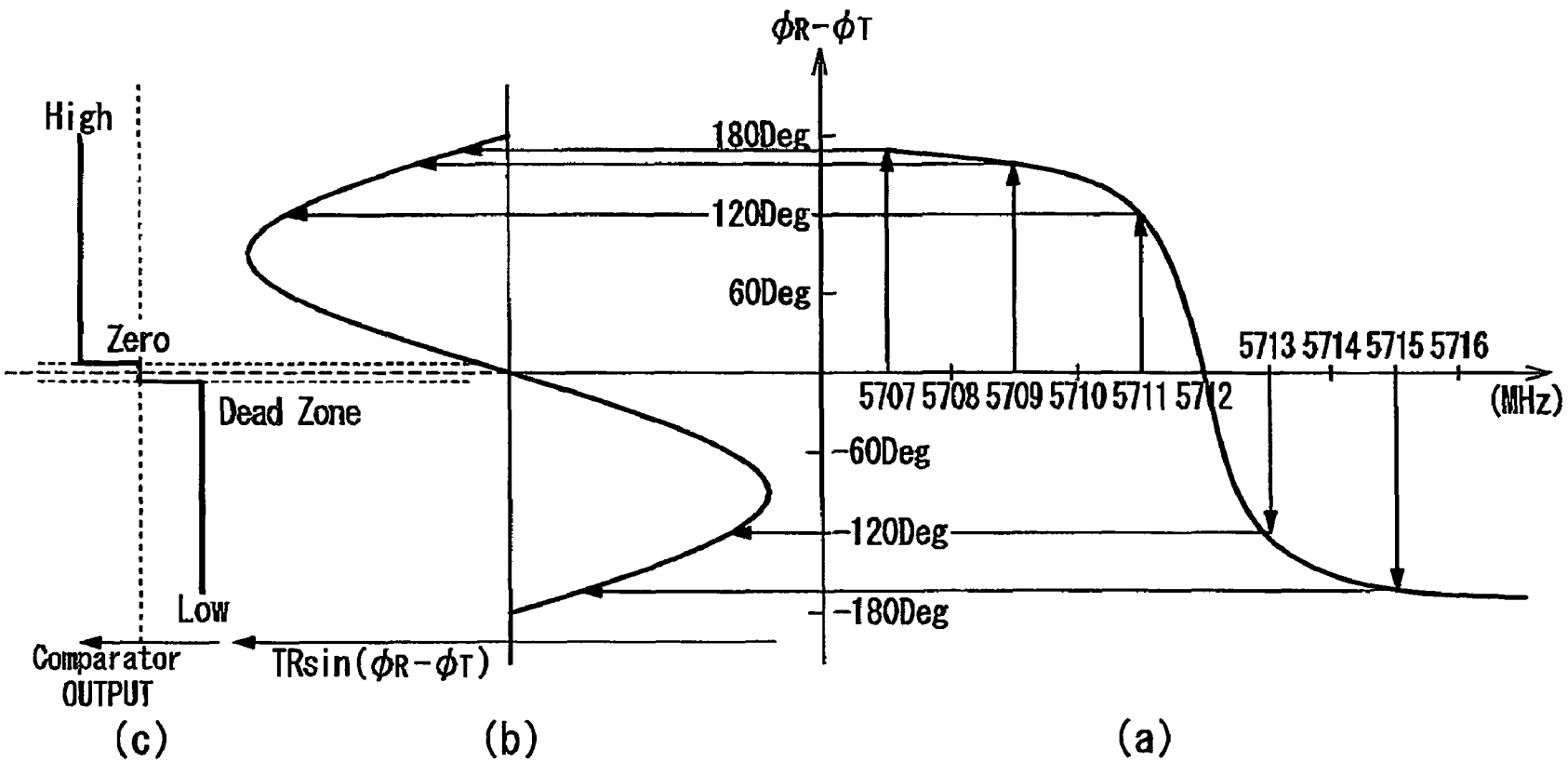
FIG. 3 is an illustration for describing signals outputted from a phase detection section.

FIG. 3(*a*) illustrates the relation between the frequency (lateral axis) of the high frequency wave 24 supplied from the high frequency oscillation section 22 and the phase difference $\phi_R-\phi_T$ (vertical axis) between the phase $\phi_T$ of the traveling wave and the phase $\phi_R$ of the reflection wave, when the resonant frequency of the resonant cavity section 30 is 5712 MHz. The phase difference $\phi_R-\phi_T$ decreases monotonically with respect to the frequency. In the region where the frequency is smaller than the resonant frequency, the phase difference $\phi_R-\phi_T$ is positive. In the region where the frequency is larger than the resonant frequency, the phase difference $\phi_R-\phi_T$ is negative.

The rate of change in the phase difference to the change in the unit amount of the frequency becomes larger in the vicinity of the resonant frequency, and it becomes smaller as going away from the resonant frequency. When the Q-value of the resonant cavity in the resonant cavity section 30 is high, the change in the phase difference is drastic in the region near the resonant frequency, while the phase difference in the region slightly away from the resonant frequency is almost constant at around +180 degree or −180 degree. The Q-value is extremely high in a particle accelerator and the like used in radiotherapy apparatus.

FIG. 3(*b*) shows the relation between the phase difference $\phi_R-\phi_T$ (vertical axis) and TR $\sin(\phi_R-\phi_T)$ (lateral axis) that is detected by the phase detection section 46. FB is a predetermined coefficient. According to FIG. 3(*b*), two values of $\phi_R-\phi_T$ correspond to a value TR $\sin(\phi_R-\phi_T)$. Thus, if there is a possibility that the value of the high frequency wave 24 is shifted from the resonant frequency by a certain extent or more, the phase difference $\phi_R-\phi_T$ cannot be determined uniquely from the value of TR $\sin(\phi_R-\phi_T)$ that is detected by the phase detection section 46. Therefore, it is not possible to perform a feedback control using the phase difference $\sin(\phi_R-\phi_T)$ for tuning the high frequency wave 24 to be the resonant frequency.

Further, since the change rate in the phase difference with respect to the change in the unit amount of the frequency becomes smaller as the frequency of the high frequency wave becomes away from the resonant frequency, the change in TR $\sin(\phi_R-\phi_T)$ becomes smaller as well. Thus, when the value of the high frequency is not close to that of the resonant frequency, it is difficult to calculate a shift from the resonant frequency based on the measured value of TR $\sin(\phi_R-\phi_T)$. Particularly, when the Q-value is high, it is difficult to perform a feedback control based on the measured value of TR $\sin(\phi_R-\phi_T)$ if the high frequency is not within the very narrow region close to the resonant frequency.

FIG. 3(*c*) shows the relation between the phase difference $\phi_R-\phi_T$ and the three-valued phase difference (Comparator output in the lateral axis) outputted from the phase detection section 46. The phase detection section 46 outputs a signal ("Zero" in the drawing) indicating that the phase of the traveling wave is coincident with the phase of the reflection wave, when an absolute value of the phase difference $\phi_R-\phi_T$ is smaller than a predetermined value. This predetermined value is set smaller as the Q-value of the resonant cavity becomes larger.

When the phase difference $\phi_R-\phi_T$ is positive and the absolute value is larger than the predetermined value, the phase detection section 46 outputs a signal ("High" in the drawing) indicating the phase-advance. When the phase difference $\phi_R-\phi_T$ is negative and the absolute value is larger than the predetermined value, the phase detection section 46 outputs a signal ("Low" in the drawing) indicating the phase-delay. Based on the signals outputted from the phase detection section 46, it is possible to judge which directions the frequency should be adjusted for making the frequency of the high frequency wave closer to that of the resonant frequency.

Next, the operation of the radiotherapy apparatus according to the present embodiment will be described. First, the patient P is laid down on the treatment table 9. The center axis A of the radiation outputted from the radiation generating device 2 is adjusted to be directed towards the diseased part of the patient P through rotating the ring around the rotation axis 11, moving the radiation generating device 2 along the circling orbit 15, the swing action of the gimbal mechanism 5, moving the treatment table 9, etc.

Then, the high frequency wave 24 is supplied to the resonant cavity section 30 while the frequency thereof is being controlled. The controlling of the frequency is carried out as follows. In the case where the phase detection section 46 judges that it is the "phase-advance" when a certain pulse is inputted from the high frequency oscillation section 22, the frequency is controlled to be increased by one pitch. The output of the phase detection section 46 is always the "phase-advance" when the supplied frequency is lower than the resonant frequency, and the frequency is increased until it exceeds the resonant frequency. Inversely, the output of the phase detection section 46 is always the "phase-delay" when the supplied frequency is higher than the resonant frequency, and the frequency is controlled to be decreased until it becomes smaller than the resonant frequency. When the judged result of the phase difference changes from the phase-advance to the phase-delay or from the phase-delay to the phase-advance, the same processing is carried out while switching the pitch to the smaller ones.

When the minimum pitch value is sufficiently small, it is possible to control the frequency only with the two-valued signs of the phase-advance and the phase-delay, having the absolute value of the predetermined value for judging the coincidence as 0 (zero).

Figure 4:
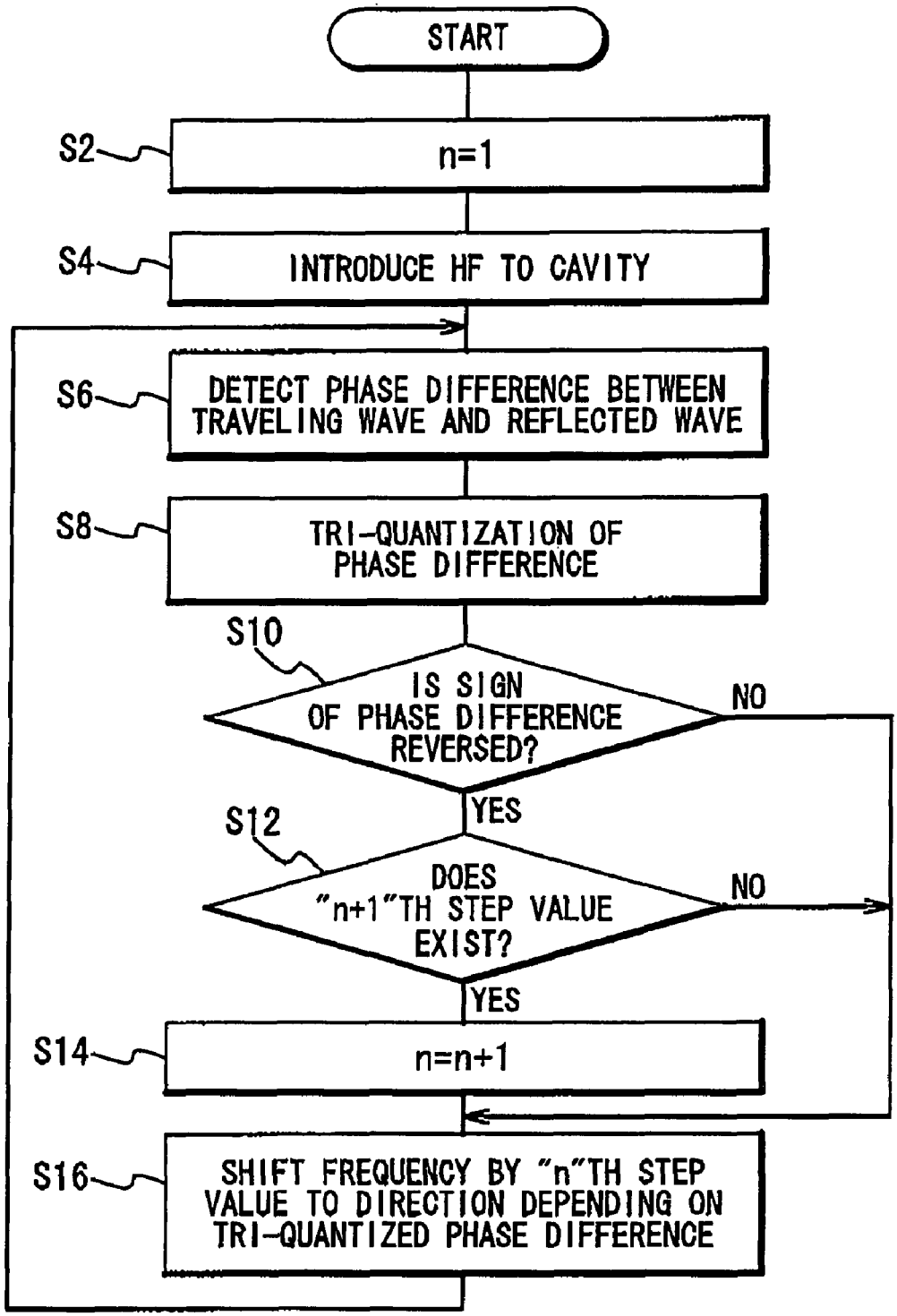
FIG. 4 is a flowchart for showing the operation of a control section.

The process of the frequency tuning operations is shown in detail in FIG. 4. The following operation is executed by a computer that is provided to the control section 45 according to the procedure in a program that is stored in the memory section 38.

First, variable n for designating the pitch value to be selected is set as 1 (step S2). Then, the high frequency wave 24 generated by the high frequency oscillation section 22 is introduced into the cavity of the resonant cavity section 30 (step S4). The phase detection section 46 detects the phase difference between the phase of the traveling wave directed towards the resonant cavity section 30 from the high frequency oscillation section 22 and the phase of the reflection wave returned to the high frequency oscillation section 22 from the resonant cavity section 30. The detected value corresponds to TR $\sin(\phi_R-\phi_T)$ shown in FIG. 3(*b*) (step S6).

The phase detection section 46 outputs the signal of the Comparator output shown in FIG. 3(*c*) which corresponds to the detected phase difference (step S8). When the detection of the phase difference performed in step S6 is the second time or thereafter, it is judged whether or not the sign of the phase difference that is three-valued in step S8 is inverted (that is, changed from the phase-advance to the phase-delay or from the phase-delay to the phase-advance) in the current detection with respect to the previous detection. When the phase difference is not inverted, the processing is advanced to step S16 (NO in step S10). When the phase difference is inverted, the processing is advanced to step S12 (YES in step S10).

It is then judged whether or not an (n+1)th pitch value is stored in the memory section 38. When it is not stored, i.e. n=4 and a fifth pitch value is not stored in the storage device 38 as in this case, the processing is advanced to step S16 (NO in step S12). When there is the (n+1)th pitch value stored in the memory section 38, e.g. when n=1 and the second pitch value is stored in the memory section 38 (YES in step S12), n is incremented by 1 (step S14) and the processing is advanced to step S16 thereafter.

Based on the phase difference that is three-valued in step SB, the frequency of the high frequency wave 24 is adjusted in the direction towards which the phase difference becomes smaller by the n-th pitch value (step S16). For example, when it is the phase-advance with n=1, the frequency is increased by the first pitch value p1=400 KHZ. When it is the phase-delay with n=2, the frequency is decreased by the second pitch value p2=200 KHz. When the phases are coincident with each other, there is no modification performed on the frequency. After this processing, the process from step S6 is carried out.

The high frequency wave adjusted in the manner described above is resonated in the resonant cavity section 30. The electrons 28 generated in the electron supply section 26 are accelerated by the high frequency wave in the resonant cavity section 30, and supplied to the metal target section 34. The X-ray 36 is irradiated from the metal target that has received the electron beam 32. The X-ray 36 is irradiated to the diseased part of the patient P.

While the X-ray 36 is irradiated to the patient P, the operation for adjusting the frequency that is described by referring to FIG. 4 is continuously performed even after the frequency tuning is once achieved.

The speed for the frequency tuning control by such method depends on the pulse repetition frequency of the high frequency wave generated by the high frequency oscillation section 22 and a target tuning accuracy. For example, when the target tuning accuracy in an electron linear accelerator of 2856 MHz is 50 KHZ, for example, the frequency needs to be increased or decreased by the pitch of 50 KHz. If the pulse repetition frequency is 100 PPS (Pulse per Second) provided that the pitch of increase and decrease is fixed at 50 KHz, it can be tuned in one second when the operation is started at the frequency that is shifted by 5 MHz. By selectively using four kinds of increase and decrease pitch values, 50 KHz, 100 KHz, 200 KHz, and 400 KHz, it is possible to tune in 15-20 pulses, i.e. in 0.15-0.2 seconds, which make the extremely high-speed tuning possible.

This method enables the appropriate frequency tuning control to be achieved at a high speed even in the case where the phase difference between the phase of the traveling wave towards the cavity and the phase of the reflection wave from the cavity is in a wide range of −180 degree to 180 degree, i.e. in any phase difference.

Further, when the high frequency resonant space as in the case of the present embodiment is applied to a particle accelerator and the like, high-frequency pulses of high electric power are to be supplied. Thus, accidental phenomena such as an electric noise, an electrical discharge, etc. are generated. In that case, if a normal feedback control such as proportional control based on the phase difference $\phi_R-\phi_T$ is carried out, there is generated disturbance and it becomes less robust. When a large time constant is given to the feedback control for overcoming this disturbance, it becomes less responsive.

With the frequency adjusting method illustrated in the present embodiment, even if there are accidental phenomena such as electric discharge generated at a certain pulse, there is only an error generated in the frequency control of one pitch and it returns to a normal control from the next pulse if an accidental phenomenon ends within that pulse. Thus, the control is very robust. Normally, the accidental phenomenon occurs in a short time such as within one pulse in a particle accelerator or the other kinds of apparatus using the high frequency. Therefore, the frequency adjusting method according to the present embodiment is a method suitable for the frequency tuning device of the particle accelerator and the like.

What is claimed is:

1. An HF frequency tuning device comprising:

an HF generator for generating a high frequency traveling wave;

a resonance cavity to which said high frequency traveling wave is introduced, said resonance cavity reflecting the high frequency traveling wave and generating a high frequency reflected wave;

a phase detecting section for detecting the high frequency traveling wave and the high frequency reflected wave in said resonance cavity, said phase detecting section generating a sign data which represents a sign of a phase difference between the high frequency traveling wave and the high frequency reflected wave;

a controlling section configured to control a frequency of said high frequency traveling wave to reduce said phase difference based on said sign data; and a storage device storing a first pitch value;

wherein said controlling section is configured to execute a first controlling process in which a frequency of said high frequency traveling wave is repeatedly shifted by said first pitch value until said sign represented in said sign data is inverted, and perform the first controlling process based on said sign represented by said sign data without using a value of said phase difference.

2. The HF frequency tuning device according to claim 1, wherein said phase detecting section generates said sign data to represent that said phase difference is zero when an absolute value of said phase difference is smaller than a predetermined value.

3. The HF frequency tuning device according to claim 1, wherein said storage device stores a second pitch value smaller than said first pitch value, and said controlling section is configured to shift a frequency of said high frequency traveling wave repeatedly by said second pitch value until said sign represented in said sign data is inverted after said first controlling process.

4. An HF acceleration device comprising:

an electron beam generator configured to generate an electron beam; and an electron accelerator configured to accelerate said electron beam, wherein said electron accelerator includes:

an HF generator configured to generate a high frequency traveling wave;

a resonance cavity to which said high frequency traveling wave is introduced, said resonance cavity reflecting the high frequency traveling wave and generating a high frequency reflected wave;

a phase detecting section for detecting the high frequency traveling wave and the high frequency reflected wave in said resonance cavity, said phase detecting section generating a sign data which represents a sign of a phase difference between the high frequency traveling wave and the high frequency reflected wave;

a controlling section configured to control a frequency of said high frequency traveling wave to reduce said phase difference based on said sign data; and a storage device storing a first pitch value, wherein said controlling section is configured to execute a first controlling process in which a frequency of said high frequency traveling wave is repeatedly shifted by said first pitch value until said sign represented in said sign data is inverted and to perform the first controlling process based on said sign represented by said sign data without using a value of said phase difference.

5. A radiotherapy accelerator comprising:

an electron beam generator configured to generate an electron beam;

an electron accelerator configured to accelerate said electron beam; and a metal target in which an X-ray is generated from an energy of entered electron beam accelerated in said electron accelerator, wherein said electron accelerator includes:

an HF generator configured to generate a high frequency traveling wave;

a resonance cavity to which said high frequency traveling wave is introduced, said resonance cavity reflecting the high frequency traveling wave and generating a high frequency reflected wave;

a phase detecting section for detecting the high frequency traveling wave and the high frequency reflected wave in said resonance cavity, said phase detecting section generating a sign data which represents a sign of a phase difference between the high frequency traveling wave and the high frequency reflected wave;

a controlling section configured to control a frequency of said high frequency traveling wave to reduce said phase difference based on said sign data; and a storage device storing a first pitch value;

wherein said controlling section is configured to execute a first controlling process in which a frequency of said high frequency traveling wave is repeatedly shifted by said first pitch value until said sign represented in said sign data is inverted, and to perform the first controlling process based on said sign represented by said sign data without using a value of said phase difference.

6. An HF frequency tuning method comprising:

introducing a high frequency traveling wave into a resonance cavity, said resonance cavity reflecting the high frequency traveling wave and generating a high frequency reflected wave;

detecting the high frequency traveling wave and the high frequency reflected wave in said resonance cavity;

generating a sign data representing a sign of a phase difference between the high frequency traveling wave and the high frequency reflected wave;

adjusting a frequency of said high frequency traveling wave to reduce said phase difference based on said sign data;

storing a first pitch value in a storage device, and executing a first controlling process in which a frequency of said high frequency traveling wave is repeatedly shifted by said first pitch value until the sign represented in said sign data is inverted, wherein the controlling process is based on the sign represented by the sign data without using a value of the phase difference.

7. The HF frequency tuning method according to claim 6, further comprising:

storing a second pitch value smaller than said first pitch value in the storage device, and shifting a frequency of said high frequency traveling wave repeatedly by said second pitch value until the sign represented in said sign data is inverted after the first controlling process.

* * * * *